US009053876B2

(12) United States Patent
Linden

(10) Patent No.: US 9,053,876 B2
(45) Date of Patent: Jun. 9, 2015

(54) LOCKABLE MANUALLY-OPERATED ACTUATOR FOR ELECTRICAL SWITCHING DEVICES

(75) Inventor: Ralph Linden, Cologne (DE)

(73) Assignee: EATON ELECTRICAL IP GMBH & CO. KG, Schoenefeld (DE)

( * ) Notice: Subject to any disclaimer, the term of this patent is extended or adjusted under 35 U.S.C. 154(b) by 85 days.

(21) Appl. No.: 13/992,796

(22) PCT Filed: Dec. 13, 2011

(86) PCT No.: PCT/EP2011/072623

§ 371 (c)(1),
(2), (4) Date: Jun. 10, 2013

(87) PCT Pub. No.: WO2012/080259

PCT Pub. Date: Jun. 21, 2012

(65) Prior Publication Data

US 2013/0270076 A1 Oct. 17, 2013

(30) Foreign Application Priority Data

Dec. 13, 2010 (EP) ..... 10194707

(51) Int. Cl.
*H01H 9/28* (2006.01)

(52) U.S. Cl.
CPC ..... *H01H 9/283* (2013.01)

(58) Field of Classification Search
USPC ..... 200/43.15, 43.11, 43.16, 327, 321; 70/212, 237, 159, 2, 232, 427
See application file for complete search history.

(56) References Cited

U.S. PATENT DOCUMENTS

| | | | | |
|---|---|---|---|---|
| 1,328,109 | A | | 1/1920 | Whitlock |
| 3,260,808 | A | | 7/1966 | Dimond et al. |
| 5,349,145 | A | * | 9/1994 | Kelaita et al. ..... 200/43.15 |
| 5,412,167 | A | * | 5/1995 | Mueller et al. ..... 200/43.14 |
| 5,467,622 | A | * | 11/1995 | Becker et al. ..... 70/203 |
| 5,998,743 | A | | 12/1999 | Unkel |

FOREIGN PATENT DOCUMENTS

| | | |
|---|---|---|
| DE | 327983 C | 10/1920 |
| DE | 1200923 B | 9/1965 |
| DE | 4206378 A1 | 9/1993 |
| DE | 19548948 A1 | 7/1997 |
| WO | WO 9728551 A1 | 8/1997 |

* cited by examiner

*Primary Examiner* — Edwin A. Leon
(74) *Attorney, Agent, or Firm* — Leydig, Voit & Mayer, Ltd.

(57) ABSTRACT

A lockable manually-operated rotary actuator for an electrical switching device includes a turning handle mounted on a housing and connected to an operating axle of the switching device. A pivotably or displaceably mounted locking member in or on the turning handle is configured to lock the turning handle in a locking position via an operative connection with the housing. At least one released locking opening is present in the locked position with at least one padlock. A protective cap is disposed over the turning handle and provides access to the at least one released locking opening, a shape of the protective cap being such that the protective cap conforms to a shape of the turning handle and is fixed to the housing via a positive connection.

8 Claims, 2 Drawing Sheets

LOCKABLE MANUALLY-OPERATED ACTUATOR FOR ELECTRICAL SWITCHING DEVICES

CROSS-REFERENCE TO PRIOR APPLICATIONS

This application is a U.S. national phase application under 35 U.S.C. §371 of International Application No. PCT/EP2011/072623, filed on Dec. 13, 2011, and claims benefit to European Patent Application No. EP 10194707.5, filed on Dec. 13, 2010. The international application was published in German on Jun. 21, 2012 as WO 2012/080259 A1 under PCT Article 21(2).

FIELD

The invention relates to a lockable manually-operated rotary actuator for electrical switching devices, such as motor protection circuit breakers or smaller circuit breakers.

BACKGROUND

Such rotary actuators are known from the publications DE 1 200 923 B, DE 42 06 378 A1 and WO 97/28551 A1. These rotary actuators can be connected to an operating axle for the switching device and are equipped with a turning handle with a pivotable or displaceable locking member and a locking opening. The locking member interacts in the locked position with a locking member of a housing on which the turning handle is arranged. In the locked position, the locking member enables a locking means to pass through the locking opening, especially the shackle of one or several padlocks which thus lock the rotary actuator and the switching device in the switched-off position.

Thus, according to DE 42 06 378 A1, the pivotable locking member of the rotary actuator provided with the locking opening has a raised or recessed locking element which either engages the raised locking element of the housing in the locked position or locks the recessed locking element of the housing in the locked position. In the locked position, an additional lug of the locking lever engages in a hole in the operating axle and blocks movement of the turning handle.

The rotary actuator according to WO 97/28551 A1 has a locking hole passing through the turning handle housing. By moving the locking member in the form of a sliding lock in the turning handle against spring force, the locking opening is released for attaching padlocks.

A disadvantage is that this type of rotary actuator can withstand limited externally-applied forces. The locking position can be forcibly overcome and the switching device can be changed from the off position to the on position contrary to safety requirements. Thus personnel and equipment are subject to significant risks. In the case of the rotary actuator mentioned at the beginning, the use of steel parts to increase resistance, commonly used in security cylinder locks or positioning actuators in chemical plants, introduces substantial disadvantages, in particular increased production costs and expenses for the electrical grounding.

SUMMARY

In an embodiment, the present invention provides a lockable manually-operated rotary actuator for an electrical switching device. A turning handle is mounted on a housing and connected to an operating axle of the switching device. A pivotably or displaceably mounted locking member in or on the turning handle is configured to lock the turning handle in a locking position via an operative connection with the housing. At least one locking opening is released in the locking position and configured to receive at least one padlock. A protective cap is disposable over the turning handle and provides access to the at least one released locking opening, a shape of the protective cap being such that the protective cap conforms to a shape of the turning handle and is fixable to the housing via a positive connection.

BRIEF DESCRIPTION OF THE DRAWINGS

The present invention will be described in even greater detail below based on the exemplary figures. The invention is not limited to the exemplary embodiment. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
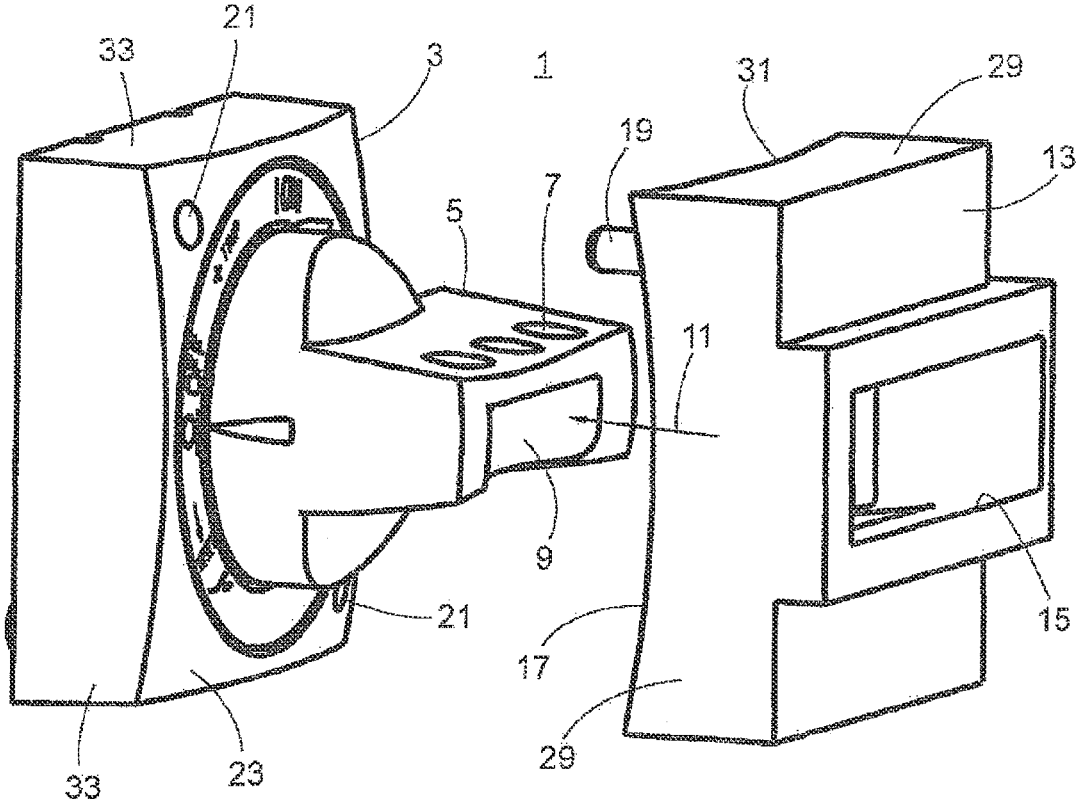
FIG. 1: shows an embodiment of the inventive rotary actuator without the protective cap from a substantially lateral view.

The invention, in an embodiment, provides a rotary actuator with simple means to protect against forcible overcoming of the locked position.

In an embodiment, a protective cap that complements the known rotary actuators can be placed over the turning handle and is essentially adapted to the shape of the turning handle, allowing access to at least one locking opening in order to make possible the mounting of a bracket for a padlock for locking the rotary actuator of the switching device in the off position. Once in place, the protective cap along with the mounted bracket is fixed on the housing via a positive connection.

The extensive coverage of the turning handle by the protective cap on the one hand and the fixation of the cap on the other hand creates a lockable rotary actuator which when compared to an unprotected rotary actuator, offers both a significantly lower surface area for gripping as well as providing a much greater resistance to externally-acting forces used to forcibly move the locked turning handle from the off position to the on position. The protection against the locked position being overcome and thus against dangerous vandalizing attacks is considerably increased in the case of the rotary actuator according to the invention, which—starting from a standard lockable rotary actuator according to the prior art—only involves easy-to-implement measures without great expense.

The housing, with which the protective cap engages in the positive connection, is in an advantageous embodiment of the invention, whereby the housing that is structurally combined with the turning handle, or—if this structural association does not exist—then the housing can be either structurally joined to the switching device to be operated via the rotary actuator, or it is in the form of a separate housing, for example an installation housing or a switching cabinet on the door of which the rotary actuator is mounted in the form of a door coupling turning handle and encloses the switching device.

In an advantageous embodiment of the invention, the back of the protective cap with respect to the switchgear is shaped in such a way that in the covering position of the protective cap or in a correspondingly shaped front-side, it engages in a corresponding shape in the housing, whereby the protective cap is arranged radially with respect to the rotation of the operating axle. The fixation of the protective cap in the axial direction is caused by at least one padlock working together with the shape of the protective cap that largely covers the turning handle.

An alternative embodiment is where the protective cap positively connects with at least one side wall of the housing via at least one of its side walls.

Another alternative, advantageous embodiment is where the protective cap positively connects via the rear face of at least one of its side walls with at least one recessed groove in the front side of the housing.

A useful embodiment is where the protective cap is an injection molded part made of plastic or metal. A plastic protective cap is simple and cheap to produce. A protective metal cap provides an even higher resistance to externally acting forces, while no additional grounding measures are required.

FIG. 1 shows the lockable manually-operated rotary actuator 1, which is connected to a switching device in the usual way via an actuator shaft inserted from the rear into the rotary actuator. The rotary actuator 1 contains a box-like housing 3 on which a turning handle 5 is captively mounted. The turning handle 5 is drawn up to one side on which there are three locking openings 7 for attaching padlocks. In FIG. 1 the locking openings 7 are covered by a locking member 9 in the position of rest. In the off position of the turning handle 5, the locking member 9 is in a known manner displaceable against spring means mounted in the housing 3 from the position of rest shown in FIG. 1 in the direction of the axial arrow 11 into a locking position. When the locking member 9 is in the locking position, it prevents the rotation of the turning handle 5 to be moved from the off position.

FIG. 1 also shows a protective cap 13 that can be placed over the turning handle 5 in the direction of the arrow 11. The protective cap 13 is an injection molded part made of plastic or metal. The protective cap 13 is adapted to the shape of the turning handle 3 in such a way that it largely covers the turning handle 3, while the entrance for mounting padlocks in the locking openings 7 is in the form of a rectangularly-recessed front-side opening 15, as shown in FIG. 2 and FIG. 3.

On placing the protective cap 13 in position, it makes a positive connection with the housing 3 while its position with respect to the housing 3 is thus fixed. This involves—diagonally opposite each other—two cylindrically shaped raised parts 19 protruding from the rear side 17 of the protective cap 13 and only one of which is visible in FIG. 1. On the other hand, there are—likewise diagonally opposite each other—two correspondingly-shaped recessed parts 21 on the front side 23 of the housing 3. On placing the protective cap 13 in position via the turning handle 3, the raised parts 19 engage in the recessed parts 21.

Figure 2:
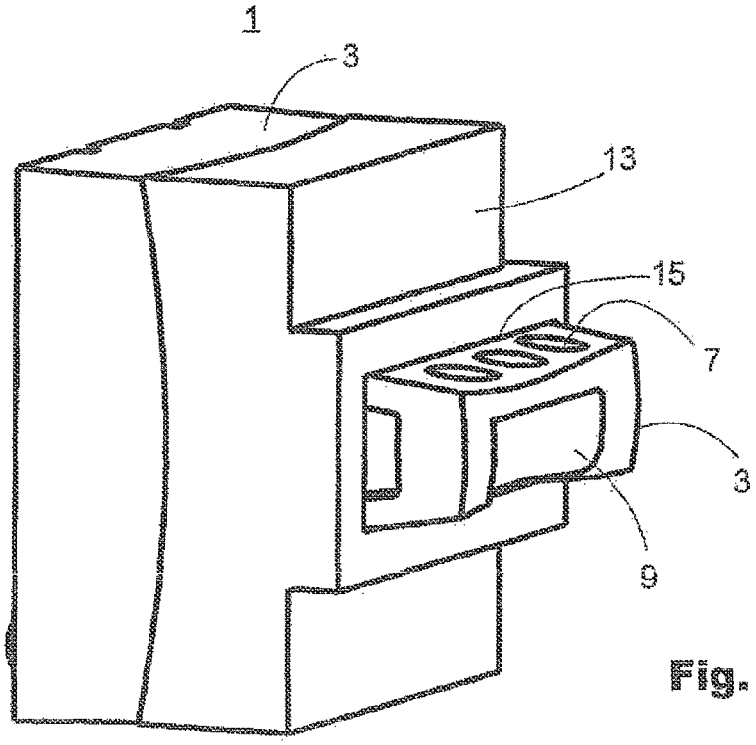
FIG. 2: shows the rotary actuator as in FIG. 1 with the protective cap in place.
Figure 3:
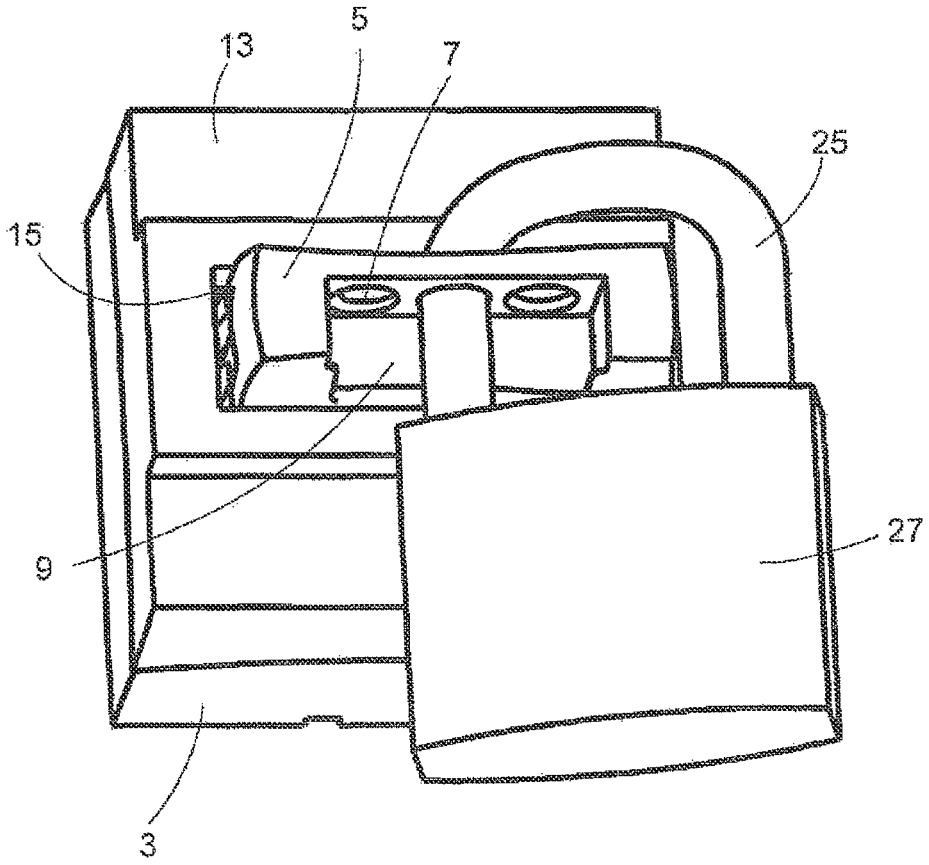
FIG. 3: shows the rotary actuator as in FIG. 2 in the locked position from a substantially frontal view.

FIG. 2 shows that the turning handle 3 is enclosed in the area of the locking opening 7 and the locking member 9 of the protective cap 13. In FIG. 2, the locking openings 7 are still blocked by the locking member 9 which is located in the position of rest. In FIG. 3, on the other hand, the locking member 9 has been moved to the locking position, so that the locking openings 7 are now accessible. Thus, as shown in FIG. 3 for the central locking opening, the bracket 25 of a padlock 27 may be passed though it. By closing the padlock 27, the rotary actuator 1 is closed and the switching device connected to the rotary actuator 1 is protected against being switched on. By means of the protective cap 13 fixed to the housing 3, the rotary actuator 1 is now protected to a much greater degree against being forcibly switched on as a result of a vandalizing act.

The present invention is not limited to the embodiments described above, but also includes all embodiments presenting the same effect as that according to the invention. Thus, the invention can, for example, be transformed in such a way that instead of the interlocking raised parts 19 and recessed parts 21, at least one of the protective cap side walls 29 is positively connected by its rear side face 31 to a recessed groove (not shown) in the front side 23 of the housing 3. It is also possible that the protective cap 13 can positively engage its protective cap side walls 29 (also not shown) with the housing side walls 33.

The invention described above is used in low voltage equipment for the control and protection of electric actuators and equipment. The inventive rotary actuator can be mounted, for example, on a cabinet door on the operator side of a switching cabinet or an installation housing or directly on a manually operated switching device.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

LIST OF REFERENCE NUMBERS

1 Rotary actuator
3 Housing
5 Turning handle
7 Locking opening
9 Locking member
11 Directional arrow
13 Protective cap
15 Release opening
17 Rear side
19 Raised part
21 Recessed part
23 Front side
25 Bracket
27 Padlock
29 Protective cap wall
31 Front face
33 Housing sidewall

The invention claimed is:

1. A lockable manually-operated rotary actuator for an electrical switching device, comprising:

a turning handle mounted on a housing and connected to an operating axle of the switching device;

a pivotably or displaceably mounted locking member in or on the turning handle configured to move from a resting position to a locking position to lock the turning handle in the locking position via an operative connection with the housing;

at least one locking opening that is blocked when the locking member is in the resting position and is released and configured to receive at least one padlock when the locking member is in the locking position;

a protective cap disposable over the turning handle and providing access to the at least one locking opening, a shape of the protective cap being such that the protective cap conforms to a shape of the turning handle and is fixable to the housing via a positive connection.

2. The lockable rotary actuator according to claim 1, wherein the positive connection is provided with the housing integrated with the rotary actuator.

3. The lockable rotary actuator according to claim 1, wherein the positive connection is provided using the housing integrated with the switching device.

4. The lockable rotary actuator according to claim 1, wherein the positive connection is provided with the housing surrounding the switching device.

5. The lockable rotary actuator according to claim 1, wherein at least one raised part provided on a rear side of the protective cap positively connects with at least one recessed part on a front side of the housing.

6. The lockable rotary actuator according to claim 1, wherein the protective cap has at least one protective cap side wall that positively connects with at least one housing side wall.

7. The lockable rotary actuator according to claim 1, wherein at least one side wall of the protective cap, at a rear face, connects positively with at least recessed groove on a front side of the housing.

8. The lockable rotary actuator according to claim 1, wherein the protective cap is an injection molded part made of plastic or metal.

* * * * *